US010328715B2

(12) United States Patent
Buckby et al.

(10) Patent No.: US 10,328,715 B2
(45) Date of Patent: Jun. 25, 2019

(54) PRINTING APPARATUS AND METHOD

(71) Applicant: Videojet Technologies Inc., Wood Dale, IL (US)

(72) Inventors: Steven John Buckby, Bleasby (GB); Philip Hart, Nuthall (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/748,248

(22) PCT Filed: Jul. 14, 2016

(86) PCT No.: PCT/GB2016/052135
§ 371 (c)(1),
(2) Date: Jan. 29, 2018

(87) PCT Pub. No.: WO2017/017408
PCT Pub. Date: Feb. 2, 2017

(65) Prior Publication Data

US 2018/0215170 A1 Aug. 2, 2018

(30) Foreign Application Priority Data

Jul. 29, 2015 (GB) ..... 1513308.5

(51) Int. Cl.
*B41J 17/04* (2006.01)
*B41J 17/07* (2006.01)
(Continued)

(52) U.S. Cl.
CPC ..... *B41J 2/325* (2013.01); *B41J 17/04* (2013.01); *B41J 17/07* (2013.01); *B41J 17/12* (2013.01);
(Continued)

(58) Field of Classification Search
CPC ... B41J 2/325; B41J 17/04; B41J 17/12; B41J 33/34; B41J 33/44; B41J 33/54; B41J 33/36
(Continued)

(56) References Cited

U.S. PATENT DOCUMENTS 5,647,679 A * 7/1997 Green ..... B41J 3/28 347/214
2004/0114024 A1* 6/2004 Bouverie ..... B41J 2/325 347/219
(Continued)

FOREIGN PATENT DOCUMENTS

| | | | |
|---|---|---|---|
| EP | 2894036 | A1 | 7/2015 |
| JP | 2007196575 | A | 8/2007 |
| WO | 2013025746 | A1 | 2/2013 |

*Primary Examiner* — Huan H Tran
*Assistant Examiner* — Alexander D Shenderov
(74) *Attorney, Agent, or Firm* — Beusse, Wolter, Sanks & Maire PLLC; Robert L. Wolter

(57) ABSTRACT

A method of operating a transfer printer (1), the transfer printer comprising first and second spool supports each being configured to support a spool (3,4) of ribbon (2), a ribbon drive configured to cause movement of ribbon (2) from the first spool support to the second spool support along a predetermined ribbon path, and a printhead (7), the printhead being configured to selectively transfer ink from the ribbon to a substrate as the substrate is moved relative to the printhead in a direction of substrate movement. The method comprises driving the ribbon in a direction parallel to the direction of substrate movement, printing a first plurality of images onto a first respective plurality of substrates, driving the ribbon in a direction opposite to the direction of substrate movement, driving the ribbon in the direction parallel to the direction of substrate movement, and printing a second plurality of images onto a second respective plurality of substrates. Printing each image of the
(Continued)

first and second pluralities of images results in corresponding pluralities of first (15 *a, b, c*) and second (16 *a, b, c*) negative images being formed on the ribbon, wherein each negative image of the first plurality of negative images (15 *a, b, c*) is located adjacent a negative image of the second plurality of negative images (16 *a, b, c*) on the ribbon.

20 Claims, 5 Drawing Sheets

(51) Int. Cl.

| | |
|---|---|
| ***B41J 17/12*** | (2006.01) |
| ***B41J 2/325*** | (2006.01) |
| ***B41J 33/14*** | (2006.01) |
| ***B41J 33/34*** | (2006.01) |
| ***B41J 33/36*** | (2006.01) |
| ***B41J 33/44*** | (2006.01) |
| ***B41J 33/54*** | (2006.01) |

(52) U.S. Cl.
CPC ..... *B41J 33/14* (2013.01); *B41J 33/34* (2013.01); *B41J 33/36* (2013.01); *B41J 33/44* (2013.01); *B41J 33/54* (2013.01)

(58) Field of Classification Search
USPC ..... 347/171
See application file for complete search history.

(56) References Cited

U.S. PATENT DOCUMENTS

| | | | | |
|---|---|---|---|---|
| 2004/0223045 | A1* | 11/2004 | Paz-Pujalt | B41J 3/4075 347/224 |
| 2006/0181597 | A1 | 8/2006 | Mindler | |
| 2011/0043590 | A1* | 2/2011 | Penzo | B41J 35/08 347/217 |
| 2012/0306986 | A1* | 12/2012 | Bouverie | B41J 35/38 347/215 |
| 2015/0239257 | A1* | 8/2015 | Yoshizawa | B41J 2/325 347/215 |

* cited by examiner

L
l
l'

2
15a
15b
15c 2
15a
16a
15b
16b
15c
16c 2
15a
16a
17a
15b
16b
17b
15c
16c
17c

PRINTING APPARATUS AND METHOD

The present invention relates to a transfer printer and a method of its operation, and more particularly, but not exclusively to a thermal transfer printer.

Thermal transfer printers make use of single use ribbon. In order to avoid ribbon wastage it is desirable to transport the ribbon between the spools, past the print head, in such a way that the position of the ribbon relative to the printhead can be accurately controlled. In this way the ribbon to be used in a new printing operation is positioned adjacent to that used in a preceding printing operation thereby minimizing ribbon wastage. Additionally, where single use ribbons are used it is important that unused ribbon is positioned at the print head during a printing operation as otherwise the printing operation will fail to transfer ink from the ribbon to a substrate thereby causing faulty printing.

The differing requirements of different types of printing technologies influence the choice of ribbon drive which is employed. For example, thermal transfer printing often has relatively challenging requirements not only in terms of accuracy of ribbon movement—as discussed above—but also in terms of ribbon acceleration and deceleration.

Moreover, some applications put especially challenging requirements on the acceleration and deceleration of a ribbon. For example, in some applications it is necessary to print a series, or burst, of images in rapid succession, with a relatively long dwell period between successive bursts. For example, where an industrial process requires articles to be processed in batches images may be required to be printed rapidly as a batch of articles are advanced past a printing location in succession (i.e. with a short period between each article being printed). In such applications conventional printing techniques may struggle to perform ribbon movement in an appropriate manner.

It is an object of the present invention to provide a ribbon drive which allows a series of images to be printed in rapid succession, while not wasting ribbon.

According to a first aspect of the invention there is provided a method of operating a transfer printer. The transfer printer comprises first and second spool supports each being configured to support a spool of ribbon, a ribbon drive configured to cause movement of ribbon from the first spool support to the second spool support along a predetermined ribbon path, and a printhead. The printhead is configured to selectively transfer ink from the ribbon to a substrate as the substrate is moved relative to the printhead in a direction of substrate movement. The method comprises:

i) driving the ribbon in a direction parallel to the direction of substrate movement;
ii) printing a first plurality of images onto a first respective plurality of substrates;
iii) driving the ribbon in a direction opposite to the direction of substrate movement;
iv) driving the ribbon in the direction parallel to the direction of substrate movement; and
v) printing a second plurality of images onto a second respective plurality of substrates.

The printing of each image of the first and second pluralities of images results in corresponding pluralities of first and second negative images being formed on the ribbon. Each negative image of the first plurality of negative images is located adjacent a negative image of the second plurality of negative images on the ribbon.

Steps (i) to (v) may be performed in the order indicated by the numbering.

The arrangement of each negative image of the first plurality of negative images adjacent a negative image of the second plurality of negative images on the ribbon may be referred to as interleaving. That is, the first plurality of negative images and the second plurality of negative images are interleaved on the ribbon.

In this way, by printing a series of images in a burst (e.g. the first plurality of images), without rewinding the ribbon between each of the images of the burst, the printing of successive images can be carried out in rapid succession. That is, there can be an extremely short non-printing time between the printing of each of the images within the burst. Further, by rewinding the ribbon between printing of successive bursts (as opposed to successive images), it is possible to arrange the negative images on the ribbon so as to be interleaved with one another, thereby reducing the wastage of ribbon that would necessarily occur if no rewinding was carried out between the printing of successive images.

In general, burst mode printing has particular application where a plurality of images are required to be printed in rapid succession such that the time taken for the ribbon acceleration, deceleration and positioning operations limits the overall printing speed to a printing speed somewhat less than a desirable printing speed. Burst mode printing allows the overall printing speed (and hence substrate speed) to be increased, without having to allow time for ribbon acceleration, deceleration and positioning operations to be carried out between each printing operation, while still allowing efficient use of printing ribbon.

Each of the first plurality of images may be offset from each of the other ones of the first plurality of images by a predetermined offset in the direction of substrate movement.

By offset from each of the other ones of the first plurality of images it is meant that each of the first plurality of images has a different position in the direction of substrate movement from each of the other ones of the first plurality of images. That is, the plurality of images do not entirely overlap each other (as is the case where multiple sub-images are printed over one another in different colours using different colour portions of a printing ribbon so as to create a multi-colour image). For example, each of the images may be offset from a preceding image of the plurality of images in the direction of substrate movement by a respective predetermined offset. Each of the respective predetermined offsets may be substantially the same, such that each of the images is offset from the respective preceding image by the same amount.

The predetermined offset may be equal to or greater than a length of the image in the direction of substrate movement. That is, each of the images may be printed onto a respective substrate such that adjacent images do not overlap one another. It will, of course, be appreciated that where images are printed immediately adjacent to one another, there may be some overlap between adjacent pixels of ink, due to inherent tolerances in the placement of pixels and the movement of substrate and ribbon. However, in general terms, it will be understood that where the offset is equal to or greater than the length of the image in the direction of substrate movement there will be substantially no overlap between adjacent images within the plurality of images.

Where each of the plurality of images is formed immediately adjacent to one another on the substrate, the predetermined offset is equal to the length of the image in the direction of substrate movement. On the other hand, where a separation exists between each of the plurality of images, the predetermined offset is greater than the length of the image in the direction of substrate movement.

Each of the second plurality of images may be offset from each of the other ones of the second plurality of images by a second predetermined offset in the direction of substrate movement. The second predetermined offset may be equal to the predetermined offset.

Each of the first plurality of images may be spaced apart from each of the other ones of the first plurality of images by a predetermined distance in the direction of substrate movement.

By spaced apart from it is meant that each of the first plurality of images is separated from an adjacent one of the first plurality of images. For example, the where adjacent images are separated by a predetermined distance, the adjacent images have a predetermined offset which comprises the predetermined distance (i.e. the separation between images) and the length of the image in the direction of substrate movement.

The ribbon may be advanced between printing each of the first plurality of images by an amount which is based upon an integer multiple of a length of each of the images in the direction of substrate movement.

The amount which is based upon an integer multiple of a length of each of the images may comprise an amount which is substantially equal to an integer multiple of a length of each of the images and an amount which is substantially equal to an integer multiple of a length of a separation between each of the images.

The first plurality of substrates may comprise regions of a single substrate.

Each of the first plurality of images may be spaced apart on said substrate by a predetermined distance in the direction of substrate movement.

The second plurality of substrates may comprise regions of said substrate.

Each of the second plurality of images may be spaced apart on said substrate by a predetermined distance in the direction of substrate movement.

Driving the ribbon in a direction opposite to the direction of substrate movement may comprise driving the ribbon by an amount which is based upon an integer multiple of a length of each of the images and the number of images in the first plurality of images.

The ribbon may be driven during the printing of each of the first plurality of images at a printing speed which is based upon the speed of movement of the substrate relative to the printhead.

The ribbon may be driven for at least some time between the printing of each of the first plurality of images at a ribbon transfer speed which is different to the printing speed.

The ribbon transfer speed may be selected such that the ribbon is advanced between printing each of the first plurality of images by an amount which is based upon an integer multiple of a length of each of the images.

The ribbon may be driven for at least some time between the printing of each of the first plurality of images at a tension monitoring speed.

Tension in the ribbon extending between the spools may be controlled so as to be substantially equal to a predetermined tension value.

Tension in the ribbon extending between the spools may be monitored at a time between the printing of at least two of the first plurality of images.

A length of ribbon to be added to or subtracted from the length of ribbon extending between the spools to control the tension so as to be substantially equal to a predetermined tension value may be determined based upon the monitored tension.

The determined length of ribbon may be added to or subtracted from the length of ribbon extending between the spools at a time between the printing of at least two of the first plurality of images.

The method may further comprise determining the diameter of at least one of the spools of ribbon during the printing of the first plurality of images, wherein the at least one spool is controlled based upon the determined diameter at a time between the printing of at least two of the first plurality of images.

According to a second aspect of the invention there is provided a transfer printer comprising: first and second spool supports each being configured to support a spool of ribbon; a ribbon drive configured to cause movement of ribbon from the first spool support to the second spool support along a predetermined ribbon path; a printhead, the printhead being configured to selectively transfer ink from the ribbon to a substrate as the substrate is moved relative to the printhead in a direction of substrate movement, and a controller arranged to cause the ribbon drive to carry out a method according to the first aspect of the invention.

It will be appreciated that features discussed in the context of one aspect of the invention can be applied to other aspects of the invention. In particular, where features are described as being carried out by the method in the first aspect of the invention it will be appreciated that such features can be used in combination with a printer according to the second aspect of the invention.

The method of the first aspect of the invention can be carried out in any convenient way. In particular the method may be carried out by a printer controller and such a printer controller is therefore provided by the invention. The controller may be provided by any appropriate hardware elements. For example the controller may be microcontroller which reads and executes instructions stored in a memory, the instructions causing the controller to carry out a method as described herein. Alternatively the controller may take the form of an ASIC or FPGA. Further the invention also provides computer programs which can be executed by a processor of a transfer printer so as to cause a ribbon drive of the transfer printer to be controlled in the manner described above. Such computer programs can be stored on computer readable media such as non-tangible, not transitory computer readable media.

Embodiments of the invention are now described, by way of example, with reference to the accompanying drawings, in which.

Figure 1:
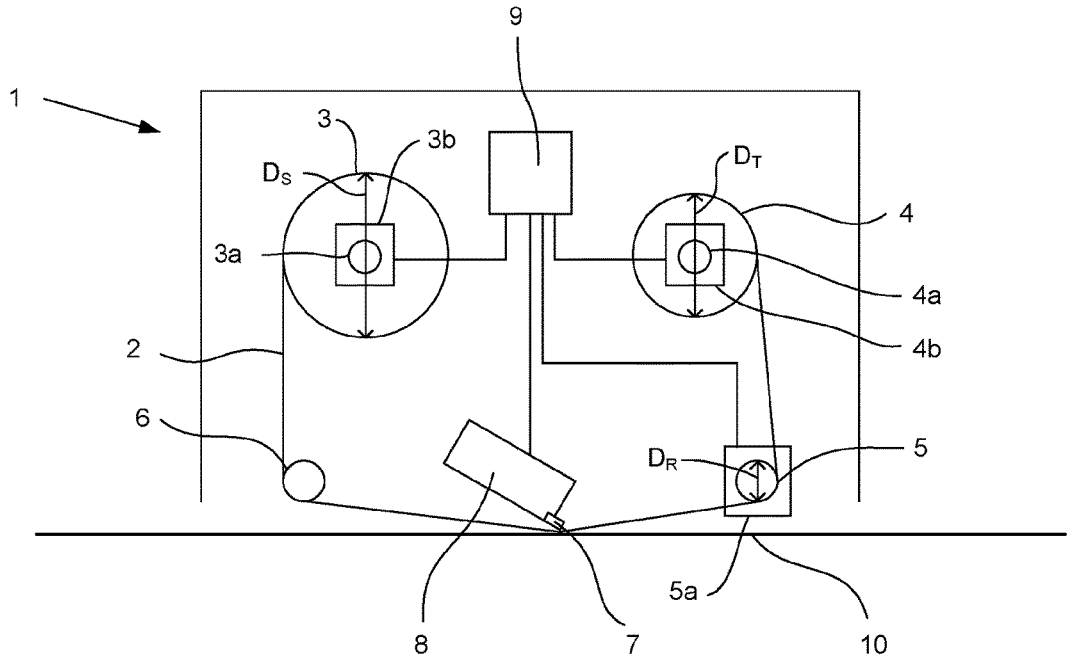
FIG. 1 is a schematic illustration of a thermal transfer printer in which embodiments of the invention may be implemented.

Referring to FIG. 1, a thermal transfer printer 1 uses an ink carrying ribbon 2 which extends between two spools, a supply spool 3 and a takeup spool 4. In use, the ribbon 2 is transferred from the supply spool 3 to the takeup spool 4 around rollers 5, 6, past print head 7 mounted to a printhead carriage 8. The supply spool 3 is mounted on a spool support 3*a* which is driven by a supply spool motor 3*b*. Similarly, the take-up spool 4 is mounted on a take-up spool support 4*a* which is driven by a take-up spool motor 4*b*. Each of the supply spool motor 3*b* and the take up spool motor 4*b* are controlled by a printer controller 9. In the embodiment described here each of the supply spool motor 3*b* and the take-up spool motor 4*b* are hybrid stepper motors (as opposed to variable reluctance or permanent magnet stepper motors). The use of a hybrid stepper motor is preferred as it gives a higher resolution (typically 1.8 degrees per full step) than other types of stepper motor, and can operate at high stepping rates with excellent holding and dynamic torque capability.

The stepper motor may be for example a Sanyo Denki motor having part number 103H7126-0440.

While during operation the ribbon 2 is generally transferred from the supply spool 3 to the take-up spool 4, the controller 9 can also energise the motors so as to cause the ribbon 2 to be transferred from the take-up spool 4 to the supply spool 3. This can be useful in some printing modes as is described further below.

The rollers 5, 6 may be idler rollers, and serve to guide the ribbon 2 along a predetermined ribbon path as shown in FIG. 1. Rotation of the roller 5 is monitored by a sensor 5*a*. Specifically, the roller 5 is provided with a magnetic element. The sensor 5*a* can then monitor changes in magnetic field caused by rotation of the roller 5. The sensor 5*a* provides a signal to the printer controller 9 comprising a number of pulses sensed by the sensor 5*a*. Given knowledge of the number of pulses generated by a single rotation of the roller 5, the pulses provided to the printer controller 9 by the sensor 5*a* can be processed to determine a number of rotations (which will usually not be an integer number) of rotations of the roller 5.

The roller 5 comprises a shaft of known diameter which is coated with a nonslip coating also of known thickness. The provision of a non-slip coating has the effect of ensuring that the roller 5 rotates consistently as the tape moves along the predetermined path. This means that the rotation of the roller 5 is an accurate indicator of ribbon movement. Rotation of the roller 5 may be used in processing carried out by the printer controller 9 so as to determine a linear length of ribbon transferred between the spools of ribbon. Knowledge of the shaft diameter and the coating thickness allows the aforementioned number of rotations to be converted into a linear ribbon movement.

In a printing operation, ink carried on the ribbon 2 is transferred to a substrate 10 which is to be printed on. To effect the transfer of ink, the print head 7 is brought into contact with the ribbon 2. The ribbon 2 is also brought into contact with the substrate 10. The print head 7 may be caused to move towards the ribbon 2 by movement of the print head carriage 8, under control of the printer controller 9. The print head 7 comprises printing elements arranged in a one-dimensional linear array, which, when heated, whilst in contact with the ribbon 2, cause ink to be transferred from the ribbon 2 and onto the substrate 10. Ink will be transferred from regions of the ribbon 2 which correspond to (i.e. are aligned with) printing elements which are heated. The array of printing elements can be used to effect printing of an image on to the substrate 10 by selectively heating printing elements which correspond to regions of the image which require ink to be transferred, and not heating printing elements which require no ink to be transferred.

The printer of FIG. 1 can be used in a mode which is sometimes referred to as a 'continuous' mode. In continuous mode printing, the printer performs a regularly repeated series of printing cycles, each cycle including a printing phase during which ink is transferred to the substrate 10, and a further non-printing phase during which the printer is prepared for the printing phase of the next cycle. The present invention has particular application in continuous printing.

In continuous printing, during the printing phase the print head 7 is brought into contact with the ribbon 2, the other side of which is in contact with the substrate 10 onto which an image is to be printed. The print head 7 is held stationary during this process—the term "stationary" is used in the context of continuous printing to indicate that although the print head will be moved into and out of contact with the ribbon, it will not move relative to the ribbon path in the direction in which ribbon is advanced along that path. Both the substrate 10 and ribbon 2 are transported past the print head, generally but not necessarily at the same speed.

Generally only relatively small lengths of the substrate 10 which is transported past the print head 7 are to be printed upon and therefore to avoid gross wastage of ribbon it is usual to reverse the direction of travel of the ribbon between printing cycles. Thus in a typical printing process in which the substrate is traveling at a constant velocity, the print head is extended into contact with the ribbon only when the print head 7 is adjacent regions of the substrate 10 to be printed. Immediately before extension of the print head 7, the ribbon 2 is accelerated up to, for example, the speed of travel of the substrate 10. The ribbon speed is then maintained at the constant speed of the substrate during the printing phase and, after the printing phase has been completed, the ribbon 2 is decelerated and then driven in the reverse direction so that the used region of the ribbon is on the upstream side of the print head. As the next region of the substrate to be printed approaches, the ribbon 2 is then accelerated back up to the normal printing speed and the ribbon 2 is positioned so that an unused portion of the ribbon 2 close to the previously used region of the ribbon is located between the print head 7 and the substrate 10 when the print head 7 is advanced to the printing position. It is therefore desirable that the supply spool motor 3*b* and the take-up spool motor 4*b* can be controlled to accurately locate the ribbon so as to avoid a printing operation being conducted when a previously used portion of the ribbon is interposed between the print head 7 and the substrate 10.

During the transfer of ribbon from the supply spool 3 to the take up spool 4, both the supply spool motor 3*b* and the take-up spool motor 4*b* are energised in the same rotational direction. That is, the supply spool motor 3*b* is energised to turn the supply spool 3 to pay out an amount of ribbon while the take-up spool motor 4*b* is energised to turn the take-up spool 4 to take-up an amount of ribbon. The motors can therefore be said to operate in "push-pull" mode. Where tension in the ribbon is to be maintained, it is important that the linear quantity of ribbon paid out by the supply spool is essentially equal to the linear quantity of ribbon taken up by the take-up spool. Additionally, as noted above it is desirable to transport a predetermined linear distance of ribbon between spools. This requires knowledge of the diameters of the spools given that the drive is applied to the spools and the linear length of ribbon transferred by a given rotational movement of the spools will vary in dependence upon the spool diameters. A technique for determining spool diameters is described in the applicant's co-pending patent application number PCT/GB2014/053104, which is herein incorporated by reference.

In some applications, it may be desirable to print a series, or burst, of images in rapid succession, with a relatively long dwell period between subsequent bursts. For example, where an industrial process requires articles to be processed in batches images may be required to be printed rapidly as a batch of articles are advanced past a printing location in succession (i.e. with a short period between each article being printed). However, once a batch of articles has been printed, there may be relatively long period before a subsequent batch of articles is advanced and requires printing. It will be appreciated that the spacing between consecutive images within a burst may vary between applications.

Figure 2:
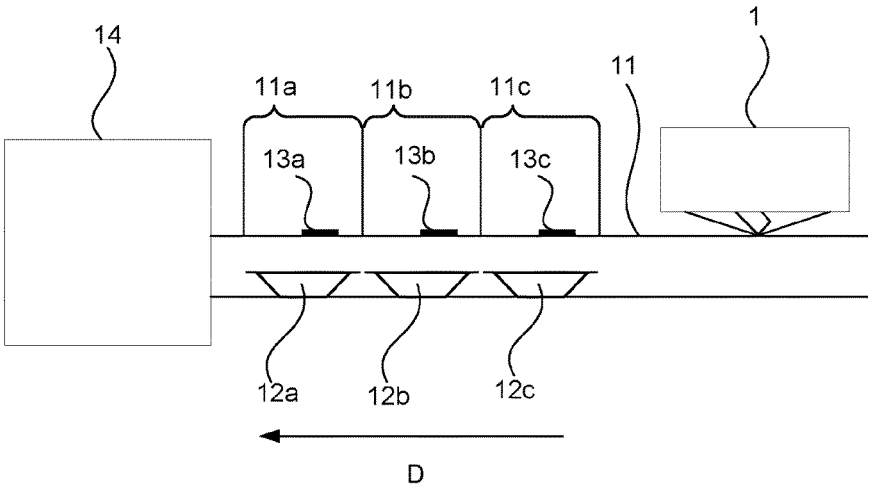
FIG. 2 is a schematic illustration of a production line which includes the thermal transfer printer of FIG. 1.

FIG. 2 illustrates one example of such an application, that of food tray preparation and packaging. A film 11 is arranged to be applied as a lid to each of a plurality of trays 12*a* to 12*c*. Prior to sealing the plurality of trays 12*a* to 12*c* a respective plurality of images 13*a* to 13*c* are printed on a respective plurality of regions of the film 11*a* to 11*c*, each region 11 a to 11*c* corresponding to a respective one of the trays 12*a* to 12*c*. Each image 13*a* to 13*c* is printed by a printer 1, for example as illustrated by FIG. 1, and may convey information such as a batch number and/or use by date of the contents of the respective tray 12*a* to 12*c*. The film 11 is thus an example of the substrate 10 onto which printing is carried out, as described above with reference to FIG. 1. The length of each image 13*a* to 13*c* may, for example, in some applications be around 50 mm. The length of each region 11*a* to 11*c* may, for example, be around 150 mm.

The film 11, once printed, is sealed to the trays 12*a* to 12*c* by a tray sealing device 14 which exerts a pressure on the film 11, while also applying heat. This causes the film 11 to melt and become adhered to a lip of each of the trays 12*a* to 12*c*. The pressure and heat are applied for a predetermined time period, which will depend on the characteristics of the trays 12*a* to 12*c* and the film 11.

It will be appreciated that such a process may be better suited to batch processing, rather than individual processing. That is, food sealing production lines are routinely arranged so as to allow the plurality trays 12*a* to 12*c* to be sealed simultaneously. In such an arrangement, the plurality of trays 12*a* to 12*c*, and a corresponding length of the film 11 are fed into a tray sealing device 14 and clamped for the sealing duration. Such an arrangement permits a more efficient operation as a single sealing time (during which the production line is stalled) is experienced for a plurality of processed trays 12*a* to 12*c*, rather than for each individual tray 12. This sealing time corresponds to the relatively long dwell time between printing bursts. While only three trays are illustrated, a typical tray production line may process trays in batches of up to six trays.

During production, the film 11 is required to be fed at a speed to accommodate the movement of the trays 12*a* to 12*c*. For example, a length of the film 11 which corresponds to the three trays 12*a* to 12*c* may be required to be delivered in a predetermined time period, before the film is held stationary while the film 11 is sealed to the trays. In order to maximize tray throughput, the speed at which the film 11 is fed is preferably high. In an embodiment, the film may be required to be driven at speeds of up to 1000 mm/s during printing. For example, the film may be driven at speeds of around 800 mm/s during printing. The images 13*a* to 13*c* are printed on each of the regions of film 11 a to 11*c* as the film 11 is advanced past the printhead in the direction indicated by arrow D. Printing operations may be carried out at a rate of around 400 prints per minute.

However, while the film advance speed is dictated by the tray production line, this also determines the speed at which the print ribbon 2 is to be driven within the printer 1. In particular, during a printing phase the ribbon is driven at substantially the same speed as the substrate 10 (i.e. film 11). In conventional printing, between the printing of each of the images 13*a* to 13*c*, the print ribbon 2 is decelerated from this speed, reversed and rewound. In particular, after the first image 13*a* is printed, the print ribbon 2 is decelerated, reversed and rewound, such that when the second one of the images 13*b* is printed the negative image on the ribbon 2 is adjacent the negative of the first image 13*a*, as described above.

As such, the printing speed, and more particularly, the speed at which print ribbon 2 is accelerated, decelerated and rewound between consecutive printing operations, can become a limiting factor. The time required for ribbon acceleration, deceleration and positioning may thus result in a maximum printing rate (e.g. in terms of prints per minute) of a printing system which is substantially less than would be possible based upon the maximum speed at which ribbon can be transported while ink is reliably transferred to a substrate.

Alternatively, where such ribbon manipulation cannot be carried out quickly enough to support a desired printing rate (and associated tray production rate), it may be decided to feed the ribbon 2 continuously with the film 11. However, given the likely spacing between images 13*a* to 13*c* on adjacent regions 11*a* to 11*c* of the film 11, this can lead to a large amount of ribbon 2 being wasted.

In order to allow a high substrate feed speed, while also to preventing significant ribbon wastage, it has been realised that by reversing the printing ribbon between print bursts, and by printing images during a second burst of printing using regions of the ribbon which are interleaved between those of a first burst, any such ribbon wastage can be significantly reduced. Moreover, a third or further burst can be printed using remaining unused portions of ribbon. In this way, a series of bursts of printing can be printed using the same length of ribbon until the ribbon is entirely (or at least substantially) used, considerably reducing ribbon wastage.

Figures 3A, 3B, 3C:
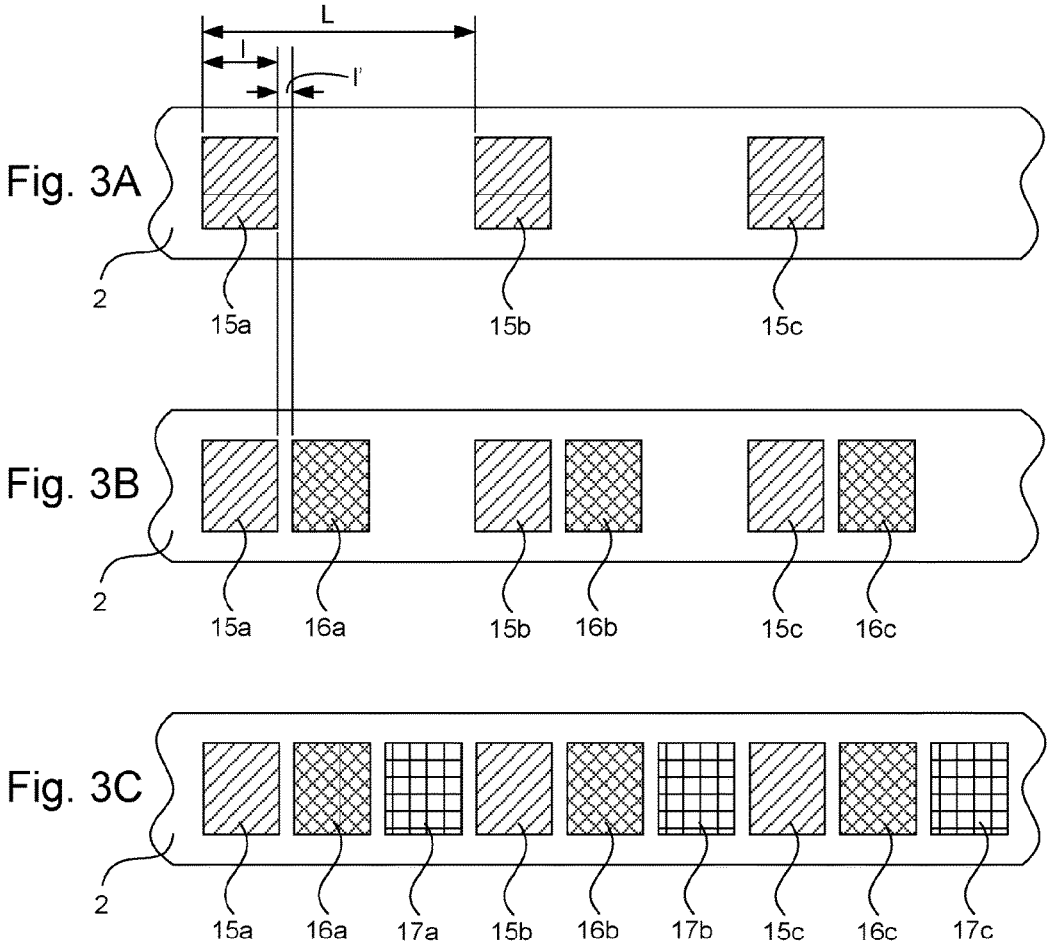
FIGS. 3A to 3C are schematic illustrations of a portion of ribbon which has been used to print a series of images using the thermal transfer printer of FIG. 1.

FIG. 3*a* shows a length of ribbon which has been used to print a first such burst of images. The ribbon is shown having a first plurality of negative images 15*a*, 15*b*, 15*c*. Each of the first plurality of negative images 15*a*, 15*b*, 15*c* corresponds to a respective image which was printed on the film 11 for a particular tray.

Once the first burst has been completed, the ribbon is rewound such that when a second burst is printed, a second plurality of negative images 16*a*, 16*b*, 16*c* is generated. This is shown in FIG. 3*b*. Each of the second plurality of negative images 16*a*, 16*b*, 16*c* corresponds to a respective image which was printed on the film 11 for a particular tray, and is adjacent a respective one of the first plurality of negative images 15*a*, 15*b*, 15*c*.

Once the second burst has been completed, the ribbon is rewound once more, such that when a third burst is printed, a third plurality of negative images 17*a*, 17*b*, 17*c* is generated. This is shown in FIG. 3*c* in which each of the third plurality of negative images 17*a*, 17*b*, 17*c* corresponds to a respective printed image, and is adjacent a respective one of the second plurality of negative images 16*a*, 16*b*, 16*c*.

This process can be continued until each of the negative images generated by the printing of the most recent burst of images is adjacent, on a first side, to an immediately preceding negative image, and on a second side to a negative image created during the first burst of printing (negative images 15*a*, 15*b*, 15*c* in this case).

It will, of course, be appreciated that different numbers of images may be printed in each burst, and that different numbers of bursts may be printed in this way before a portion of ribbon is considered to be 'used'. Such numbers may be referred to as burst parameters and will depend on various factors, such as, for example, the size of each printed image, the spacing between the images on the substrate, the speed of the substrate, and the maximum speed (and acceleration) characteristics of the printer. While the spacing between images on the substrate is referred to above, it will be appreciated that, in general terms there is an offset between adjacent images on a substrate. If the offset is greater than the image length (in the direction of substrate movement) then there will be a separation or gap between adjacent images. Alternatively, if there is no separation between adjacent images (i.e. they are immediately adjacent to one another) the offset will be equal to the image length. It will further be appreciated that the offsets between consecutive images within a burst is in many cases equal, and greater than the image length. The offset between consecutive images within a burst is often determined by the requirements of a particular application. As such, the offset between consecutive images within a burst is often predetermined, and printing activities are controlled so as to ensure that the images are printed with the predetermined offset. The determination of the spacing between (negative) images on the ribbon is discussed in more detail below.

The number of images in a burst (i.e. in a plurality of images) may, in some embodiments, be two images. In other embodiments, the number of images in a burst may be three images or more than three images. Further, the number of bursts in a series of bursts (i.e. before a portion of ribbon is considered to be 'used') may, in some embodiments, be two bursts. In other embodiments, the number of bursts in a series may be three bursts or more than three bursts.

In determining the spacing of negative images on the ribbon 2, it is particularly advantageous for the negative images to be arranged such that they are spaced apart by an integer multiple of image lengths (i.e. a length of each image I in the direction of ribbon transport). Such an arrangement allows for convenient interleaving of images from subsequent bursts and consequently minimal wasted ribbon.

Further, a small gap I' may also be left between adjacent images, so as to prevent print quality degradation. For example, if 'adjacent' images were arranged to be immediately adjacent to one another, with no gap I', even a very small positional error could lead to significant print quality degradation due to overlapping images. It will further be appreciated that in normal printing the ribbon is only required to be moved by approximately the image length between the printing of consecutive images. However, during burst mode printing, the print ribbon may have been moved forwards and backwards by distances of, for example, around 1000 mm between the printing of images which are adjacent one another on the ribbon. The accumulation of very small positional errors during each phase of this ribbon movement could result in overlapping images and subsequent print quality degradation. As such, the gap I' left between adjacent images in burst mode printing may be increased slightly with respect to any gap left between adjacent images in normal printing.

The provision of a gap I' thus allows a compromise to be found between a desire to increase ribbon usage efficiency (i.e. by reducing wasted ribbon) and reduce the occurrence of print quality degradation (i.e. due to partially overlapping images). A gap I' of approximately 1 mm or less between adjacent images may be sufficient to reduce the amount of ribbon wasted to an acceptable level. A gap I' of greater than 0.5 mm may be sufficient to reduce the risk of print quality degradation to an acceptable level. As such, consecutive images within a burst, each having a length I, may be arranged with an image pitch (i.e. distance between equivalent parts of the images) of L. The pitch L may be calculated according to the following formula:

$$L=m(I+I') \tag{1}$$

where:

m is an integer (which corresponds the number of bursts in a series before the pattern is repeated), and I' is the gap (which is generally small compared to the image length I).

Figure 4:
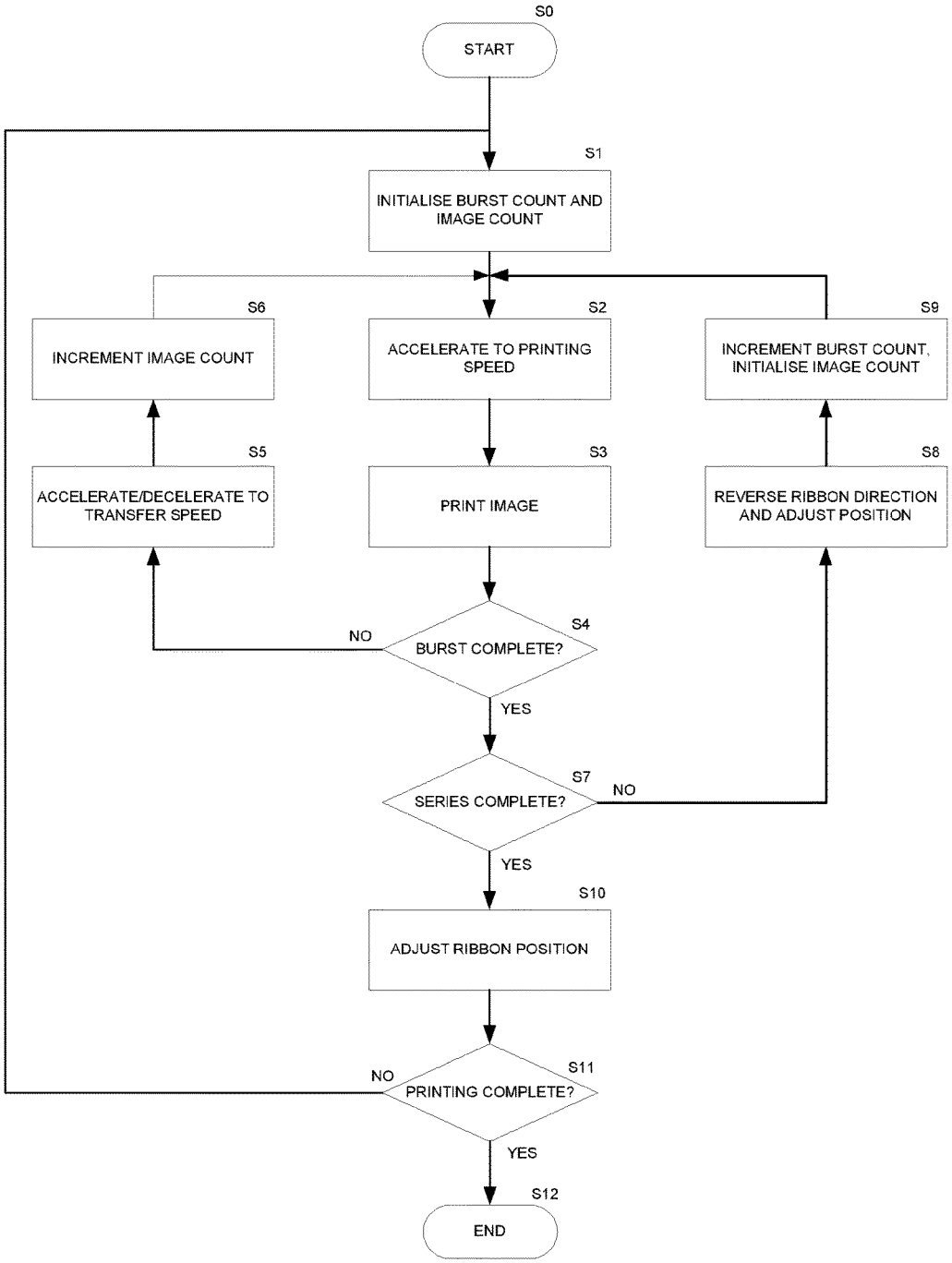
FIG. 4 is a flowchart showing steps of a method of operating the thermal transfer printer of FIG. 1.

FIG. 4 illustrates processing carried out by the printer controller 9 in order to control the printer 1 to carry out the printing operations described above. Processing begins at step S0 and passes immediately to step S1, where a burst counter, and an image counter are initialised. Processing then passes to step S2 where the ribbon is accelerated to a printing speed at an appropriate rate and time to ensure that the printing can be carried out as determined by the requirements of the particular application. Once the printing speed has been achieved, processing passes to step S3, where, at an appropriate time, an image is printed on the substrate 10.

Once printing has been completed, processing passes to step S4 where a decision is made whether a particular burst is complete. If the image counter is less than the number of images required in a burst then processing passes to step S5 where the ribbon speed is adjusted to a transfer speed. The selection of the transfer speed, and any required acceleration or deceleration from the printing speed, provide some control over the amount of ribbon transferred between the spools between the printing of consecutive images. Further, the transfer speed may also be selected to be a speed which is convenient for other reasons, such as, for example, ribbon tension measurement. The selection of the transfer speed is discussed in more detail below.

Processing then passes to step S6 where the image counter is incremented.

Processing then returns to step S2. The processing of step S2 to S4 (and steps S5 and S6 if necessary) is then repeated until the required number of images has been printed in the current burst.

Once the required number of images has been printed for the current burst (i.e. as determined at step S4), processing passes from step S4 to step S7. At step S7 a decision is made whether a particular series of bursts is complete. As described above, several bursts are printed using a portion of ribbon, such that the printed negative images are interleaved on that portion of ribbon. In the example described with reference to FIG. 3, the series of bursts comprises three bursts. Of course, different numbers of bursts are appropriate in different scenarios. Thus, at step S7 the burst counter is compared against a required burst number. If more bursts are required, processing passes to step S8.

At step S8 the ribbon is decelerated and then driven in the reverse direction (i.e. rewound onto the supply spool) so as to position the ribbon such that a subsequent printing burst can be performed using unused regions of ribbon adjacent to each of the regions of ribbon used during the preceding burst. The movement of ribbon in the reverse direction may be referred to as a rewind phase. The length of ribbon that is rewound is greater than the distance between the first and last negative images of the preceding burst on the ribbon and also allows for the ribbon to be accelerated up to printing speed prior to the region of ribbon being printed arriving at the print head during the first printing operation of the subsequent burst. The ribbon rewind distance is discussed in more detail below.

Processing then passes to step S9, where the burst counter is incremented, and the image counter reset. Processing then once again returns to step S2, and the processing of steps S2 to S7 (and steps S8 and S9 if necessary) is repeated until the required number of bursts has been completed.

When step S7 determines that the required number of bursts has been completed in the present series of bursts, processing passes from step S7 to step S10, where the ribbon is positioned such that subsequent printing operation can be performed using unused regions of ribbon adjacent to the ribbon used during the preceding printing operation. Processing then passes to step S11 where a decision is made as to whether the present series of printing bursts is complete. If yes, then processing passes to step S12, where processing terminates. On the other hand, if printing is not complete and more printing is required, processing returns to step S1, and steps S1 to S11 are repeated until printing is complete.

In general the processing described above is carried out by the controller 9 so as to perform printing as required by the packaging system with which the printer 1 is associated. It will be appreciated, therefore, that the processing may be adapted to suit the particular requirements of such a system. For example, printing may be terminated or paused during a burst, or between bursts where a series of bursts has not been completed. As such, a subsequent printing operation may have different burst parameters (e.g. number of bursts in a series, number of images in a burst) and/or image parameters (e.g. image length, image separation), and may not be able to resume printing without advancing the printing ribbon beyond the partially used portion of ribbon. However, where printing is resumed with compatible burst and image parameters, the partially used ribbon made be reused as appropriate.

The processing described above with reference to step S5 may itself involve a plurality of different processing steps. At its simplest, the processing at step S5 may cause the ribbon to be advanced at the printing speed. That is, ribbon which was accelerated to the printing speed at step S2, may be driven at the printing speed throughout the printing burst with printing occurring at step S3 as many times as is required to meet the requirements of the burst. It may be that such processing results in negative images on the ribbon being spaced at an integer multiple of the image length, allowing efficient usage of ribbon. Alternatively, where this is not the case, some ribbon may be wasted. However, this may be more than compensated by the reduced processing complexity. In any case, the worst case scenario is that slightly less than a single image length of ribbon is wasted for each set of images within a series of bursts. That is, at worst, there will a plurality of unused portions of ribbon which are each slightly shorter than the image length, and which number the same number of bursts in each series of bursts.

On the other hand, the ribbon transfer speed may be adjusted during the processing of step S5 so as to ensure that (to the extent possible) the negative images on the ribbon are spaced at a integer multiple of the image length. This ensures that the unused portions of ribbon which remain between negative images are generally suitable for the printing of a subsequent image (i.e. the unused portions are not too narrow to be used for subsequent printing). Of course, small gaps (I') are intentionally left between adjacent printed images, however, these are typically extremely small when compared to a printed image.

Figure 5:
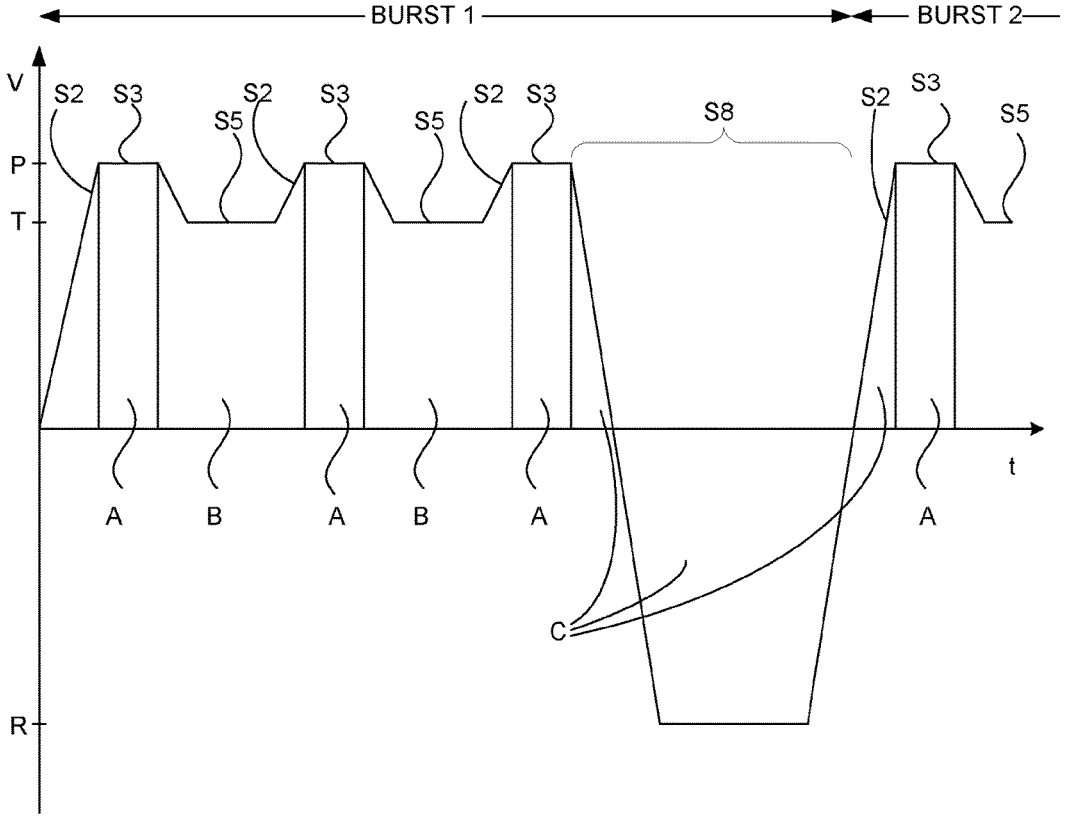
FIG. 5 is a schematic illustration showing a velocity profile of a ribbon as controlled by the thermal transfer printer of FIG. 1.

FIG. 5 illustrates an example ribbon velocity profile of a single burst of printing. It can be seen that from an initial stationary condition (i.e. ribbon speed=0), the ribbon is accelerated up to a printing speed P. This acceleration phase corresponds to processing step S2. Once the printing speed has been reached, the ribbon speed is maintained at this printing speed, and the printing of a first image of a first burst is carried out. This corresponds to a first instance of processing step S3.

Once this first printing is complete, the ribbon speed is reduced to a transfer speed T. This corresponds to processing step S5.

In the illustrated example, which could, for example, correspond to the printing shown in FIG. 3, the ribbon is then accelerated back up to the printing speed P (step S2), and a second image is printed (step S3), and so on. This process continues until the printing burst is complete, and the ribbon is decelerated and reversed at a reverse speed R. This corresponds to step S8. Once a sufficient length of ribbon has been rewound, the ribbon is again then accelerated back up to the printing speed P (step S2), and a first image of a second burst is printed (step S3), and so on. This process continues until the series of printing bursts is complete.

The distance moved by the ribbon during each of the phases described above can be understood with reference to the area enclosed by the velocity profile. That is, the integral of the velocity profile provides the distance moved by the ribbon in any given time period. In some embodiments, the distance will be determined with reference to the number of steps moved by each of the stepper motors. That is, given the knowledge of the diameter of a spool of ribbon, the distance moved by the ribbon will be directly proportional to the number of steps applied the stepper motor driving that spool.

The distance covered by the ribbon during each of the printing phases, indicated by letter A is equal to the length of each printed image I. Further, the distance moved between consecutive images within a burst is indicated by the letter B. The distances A and B are together equivalent to the distance Las defined by equation (1). Further still, the net distance moved in the reverse direction during the deceleration, rewind and re-acceleration phases is indicated by letter C (which comprises portions of forward motion and portions of reverse motion).

In order to ensure that the first image of a second burst is placed adjacent to the first image of a first burst (with a gap I'), the velocity profiles are adjusted such that the net reverse distance C is equal to an integer multiple of the sum of the distances A and B, less the distance A (so as to avoid re-using ribbon which has already been used), and the distance I' (to provide a small gap). This relationship can be expressed as follows:

$$C=n(A+B)-A-I' \quad (2)$$

where n is the number of images in a burst (three in this example).

This expression can also be combined with equation 1, which describes the relationship between the distances A and B, in which A is equivalent to I, and A+B is equivalent to L to yield the following expression:

$$C=n*(m(I+I'))-I-I' \quad (3)$$

Which can be simplified to:

$$C=(n*m-1)(I+I') \quad (4)$$

It is thus possible to calculate the required net reverse distance C in terms of the burst printing parameters. Moreover, as described above, the ribbon speed during the non-printing intervals (both between images within a burst, and during the rewind phase between bursts) can be adjusted so as to ensure that the ribbon position is accurately maintained to achieve efficient ribbon usage.

A further consideration for ribbon drive systems is the maintenance of ribbon tension. That is, to ensure good print quality, the tension in the ribbon extending between the spools should be maintained at an acceptable level. Where tension in the ribbon is to be maintained, it is important that the linear quantity of ribbon paid out by the supply spool is essentially equal to the linear quantity of ribbon taken up by the take-up spool. However, even where measures are used to ensure that the linear quantity of ribbon paid out and taken up is substantially the same, tension errors can accumulate over time.

The maintenance of ribbon tension may be particularly important during burst mode printing where significant lengths of ribbon are transferred in a single continuous series of movements. For example, a burst comprising six images, each being printed onto a tray which is 150 mm in length, would result in a transfer of 900 mm of ribbon between spools (excluding any ribbon required for acceleration and deceleration). The transfer of such a large quantity of ribbon without any tension monitoring or control may result in unacceptable variations in ribbon tension.

As such, in some embodiments, tension within the ribbon is measured multiple times during a burst. For example, tension may be measured during the non-printing ribbon transfer period between printing images. This period is described above with reference to processing step S5, and includes a period during which the ribbon is transported at a transfer speed, which may be different to the printing speed. While it is described above that this transfer speed may be selected so as to cause the separation between negative images on the ribbon to be an integer multiple of image lengths, this speed may also be selected so as to provide a constant predetermined tension monitoring speed at which ribbon tension can be readily monitored. Further, tension monitoring may be performed within a predetermined range of tension monitoring speeds.

Further, the ribbon speed may vary within this non-printing period. In this way, during a first non-printing sub-period ribbon may be transferred at the tension monitoring speed, and during a second non-printing sub-period ribbon may be transferred at a transfer speed selected to ensure correct ribbon positioning for a subsequent printing operation. Further still, adjustments may be made to the ribbon acceleration and deceleration profile to enable correct ribbon positioning.

In some embodiments, the selection of a particular ribbon speed within the predetermined range of tension monitoring speeds may be based upon ribbon positioning requirements. That is, a ribbon speed during the non-printing period may be selected that is both within the predetermined range of tension monitoring speeds and also allows correct ribbon positioning.

In addition to the tension monitoring being performed during the non-printing period, the ribbon speed and/or acceleration profile may vary within the non-printing period so as to enable corrections to be made to ribbon tension. For example, a length of tape may be added or subtracted from the tape path by one or both of the take-up and supply motors 3*b*, 4*b* based upon a tension measurement made during the same movement period, i.e. without the ribbon having come to rest.

Ribbon tension monitoring and correction operations are generally performed during periods in which the printhead is not in contact with the ribbon. That is, any period of ribbon movement other than the printing period may be used for ribbon tension monitoring or correction. The monitoring of ribbon tension may be carried out during a transfer of at least a predetermined linear quantity of ribbon, such as, for example 10 mm. The monitoring of tension can be carried out based upon the monitoring of power consumed by the supply spool motor 3*b* and the take-up spool motor 4*b* using the techniques described in our earlier patents, for example U.S. Pat. No. 7,150,572, the contents of which are incorporated herein by reference.

Alternatively tension can be monitored using a tension monitoring device such as a load cell positioned such that that ribbon (directly or indirectly) bears against the load cell such that the tension in the ribbon is measured by the load cell. Other tension monitoring techniques are of course well known in the art.

It will further be appreciated that ribbon tension monitoring and correction may be performed during both forwards and reverse periods of ribbon movement. For example, during a rewind phase such as that described above at step S8, the ribbon tension may be periodically measured and adjusted. That is, the rewind speed may be selected such that tension monitoring can be conveniently performed, and a length of tape may be added or subtracted from the tape path by one or both of the take-up and supply motors 3*b*, 4*b* based upon the tension measurement. Further, during an extended period of movement such as the rewind phase, tension monitoring may be performed at a convenient interval. For example, in some embodiments, ribbon tension may be measured every 25 mm of ribbon transferred and adjusted accordingly during a subsequent 25 mm of ribbon transfer. As such, the rewind phase may comprise a plurality of alternating ribbon tension measurement and ribbon tension adjustment sub-phases.

Tension correction can be achieved in a number of ways. The addition or subtraction of a particular length of tape from the tape path by one or both of the take-up and supply motors may comprise the calculation of a number of steps or sub-steps of a stepper motor which correspond to that required length of tape (also taking into account the angular size of each step or sub-step, and the diameter of the relevant spool of ribbon—as discussed in more detail below). Once the number of steps has been calculated, the steps may be added during a convenient period of tape transport, such as, for example a period of constant speed transport.

For example, during an extended period of ribbon movement such as the rewind phase, the ribbon may, for example, be being transported at a constant linear speed of 500 mm/s. To effect a tension correction during a movement of 25 mm of ribbon, as discussed above, one motor may be driven at a slightly higher or lower speed than the other motor. For example, the motor paying out ribbon may be driven at a speed of 510 mm/s, while the motor taking-up ribbon may be driven at a speed of 500 mm/s. Such a speed discrepancy corresponds to a correction of approximately 0.5 mm of ribbon being added to the ribbon path over a movement of 25 mm. In terms of motor steps, such a correction may, for example, correspond to three additional one eighth-step micro-steps being turned by the relevant motor.

It will be appreciated that care should be taken to ensure that ribbon tension correction operations do not result in any degradation in print quality. For example, in normal operation (i.e. without significant rewinding operations) additional ribbon is preferably added to the ribbon path, rather than being subtracted from it, so as to reduce the likelihood of overprinting on portions of ribbon which have already been printed. However, where significant lengths of ribbon are un-wound and then re-wound, care should be taken that there is not significant positional drift between the printing of a first burst and a subsequent burst, which could also result in overprinting.

In more detail, so as to avoid overprinting when tension corrections are applied, a correction is generally arranged such that the portion of ribbon 2 which is immediately under the printhead 7 is not caused to move as a result of an amount of ribbon 2 being added to or subtracted from the tape path. Tension corrections may thus be split between each of the two motors 3*b*, 4*b* with a portion of the correction amount applied to each motor. Where the printhead 7 is approximately half way around the ribbon path between the two spools 3, 4, the correction amount is split equally between each motor 3*b*, 4*b*. For example, if a correction amount of 0.5 mm of ribbon is required, 0.25 mm additional ribbon may be paid out by the supply spool motor 3*b* and 0.25 mm less ribbon taken up by the take up spool motor 4*b*. This division of the correction amount of ribbon will thus minimize any movement at the centre of the ribbon path (i.e. at the printhead 7).

Further, where the correction amount is effected by means of a change in motor drive speed (as described above), the same principal may be applied. In the example given above, the motor speeds may be adjusted so as to be driven at 495 mm/s and 505 mm/s, (rather than 500 mm/s and 510 mm/s) resulting in minimal movement of the portion of ribbon at the printhead when compared to the situation where both motors 3*b*, 4*b* are driven at 500 mm/s).

It will further be appreciated that where stepper motors are used, any ribbon correction amount will be limited in resolution by an amount which corresponds to the minimum control unit of the stepper motor (such as, for example, a one-eighth micro-step). Further, where the spool diameters 3, 4 are substantially different (as is the case at the beginning and end of a spool of ribbon), this minimum resolution will vary significantly between supply and take up spools 3, 4. As such, the correction amount of ribbon may be calculated for the spool having the largest ribbon diameter first and the remainder of the correction amount applied to the motor with the smaller diameter. Such a division of the correction amount improves the likelihood of any desired correction amount being applied accurately.

Similarly, if the printhead 7 was positioned such that it was not substantially midway between the two spools 3, 4, the division of any correction amount could also be adjusted according to the relative distance between the printhead 7 and each of the spools of ribbon 3, 4 (i.e. and not be divided equally between the two spools 3, 4).

As described above, knowledge of the diameters of the spools is required to provide accurate control of the spools so as to achieve transfer of a given linear length of ribbon between the spools. Further, the techniques described in PCT/GB2014/053104can be used to determine this information. However, in some embodiments spool diameters are determined more frequently that this technique would allow. That is, the existing techniques perform spool diameter updates at most once during every tape transfer operation (i.e. once every printing cycle). However, such techniques as applied to burst mode printing would allow spool diameter updates to be made only once per burst, which may involve the transfer of a considerable length of ribbon. It will be appreciated that during such a long transfer of ribbon the spool diameters may vary to a significant extent. As such, spool diameters may be determined, and updated, multiple times during a single tape transfer operation.

Figure 6:
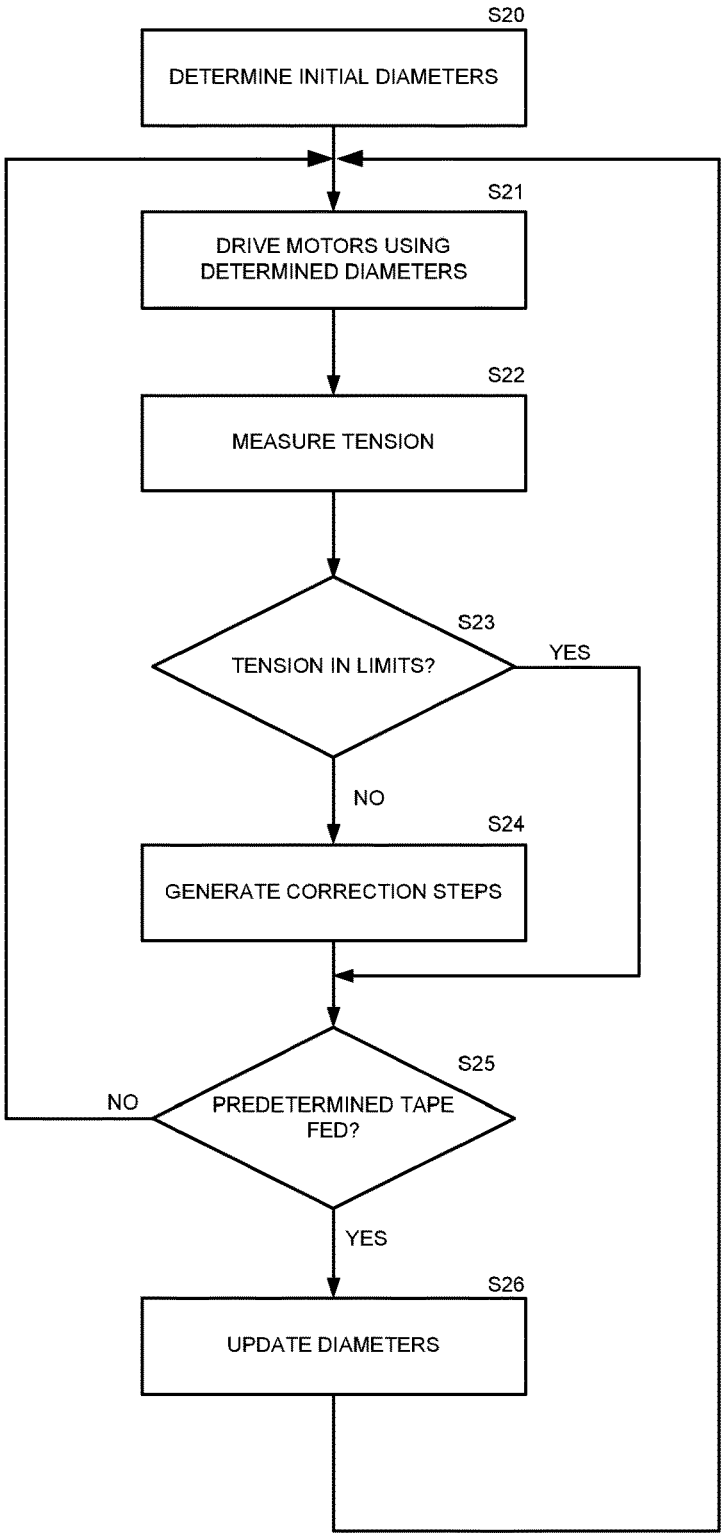
FIG. 6 is a flowchart showing steps of a method of operating the thermal transfer printer of FIG. 1.

FIG. 6 shows processing which is carried out by the controller 9 to update spool diameter values, and to monitor and maintain tension. At step S20 initial diameters are determined, for example using the processing described in PCT/GB2014/053104. At step S21 the motors 3*b*, 4*b* are controlled to transfer ribbon from the supply spool 3 to the take-up spool 4 by providing step commands to each of the motors 3*b*, 4*b*, the ratio of the number of steps provided to the motors being in inverse proportion to the spool diameters as determined at step S20. The transfer of ribbon may, for example, be associated with the printing of single image within a burst. After the transfer of ribbon, tension in the ribbon is measured at step S22. Tension may be measured during a subsequent transfer of ribbon, such as, for example, during a non-printing period within a printing burst—as described above with reference to step S5 of FIG. 4. As described above, it is preferable that the tension measurement is carried out while the ribbon is moved at a constant and predetermined speed, and while the printhead is not engaged with the ribbon.

At step S23 a check is carried out to determine whether the measured tension is within predetermined limits. If tension is not within predetermined limits, processing passes to step S24 where a quantity of ribbon to be added to or subtracted from the ribbon path is determined, and converted into a number of motor steps (using the spool diameters as determined at step S20) as described above. These motor steps will be added to the steps applied to the take up and supply spool during a subsequent ribbon transport operation at step S21. For example, a tension correction quantity of ribbon which is determined during a non-printing period may be added to the ribbon path during the acceleration phase leading to the subsequent printing operation (e.g. at step S2 of FIG. 4). Where a quantity of ribbon which is to be added to the ribbon path during an acceleration phase the quantity of ribbon may, for example, be converted into a duration of time at the final speed (i.e. the expected speed after the acceleration phase is complete. The onset of the acceleration of one of the motors is then offset by that duration of time, so as to allow for the acceleration of the two motors to be offset by the appropriate amount, resulting in the correction quantity of ribbon being added to or subtracted from to the ribbon path.

Processing passes from step S24 to step S25. If it is determined that tension is within predetermined limits at step S23 processing passes directly from step S23 to step S25.

At step S25 a check is carried out to determine whether a predetermined quantity of ribbon has been transferred between the spools. In some embodiments the predetermined quantity of ribbon is 750 mm although any suitable quantity of ribbon may be used. This quantity of ribbon is that which is to be transported before spool diameters (as used in the processing of step S20) are updated. If it is determined that the predetermined quantity of ribbon has not yet been transported, processing returns to step S21.

Otherwise, processing passes from step S25 to step S26 where the diameters of the spools are updated. The processing of step S26 involves processing the spool diameters as previously determined together with a current ratio of spool diameters based upon the number of steps which has been provided to each motor since the spool diameters were last updated, for example using techniques described in PCT/GB2014/053104. Processing returns from step S26 to step S21 where the motors are driven using the newly-updated spool diameters.

In addition, or alternatively, to the processing described above, the spool diameter values stored by the controller may be periodically updated with reference to the linear length of tape taken-up, or paid out by the relevant spool. For example, the nominal thickness of the ribbon 2 is known and remains constant throughout the length of a spool of ribbon. Given knowledge of the initial spool diameters for each spool of ribbon, and by monitoring the accumulated ribbon fed through the printing apparatus, it is possible to perform a calculation to determine the thickness of ribbon wound onto or paid out from a spool. For example, each time a motor (and its associated spool) completes a full revolution, a value representing twice the thickness of ribbon can be added to or subtracted from the spool diameter as appropriate.

Further, the controller may be arranged to monitor the rate of change of spool diameter values so as refine the nominal thickness of the ribbon 2 stored by the controller. That is, spool diameter values determined using techniques described above (or in our earlier patent application PCT/GB2014/053104) may be used to improve the accuracy of the initial value for the nominal thickness of the ribbon 2 stored by the controller. Such diameter updates (i.e. those based upon a nominal ribbon thickness) may provide sufficiently accurate ribbon transport to allow ribbon transport operations of up to around 1000 mm (such as may be required while rewinding lengths of partially used ribbon between bursts) without additional ribbon length or tension correction being carried out.

In addition, in some embodiments a roller (such as, for example, roller 5) may be used to monitor the length of ribbon passing the roller so as to provide a comparison between the length of ribbon actually transported, and the length of ribbon expected to have been fed based upon the estimated spool diameters. However, it is noted that care should be taken with any such approach so as to avoid discrepancies between estimated and measured values which could be caused by issues such as lag (e.g. between ribbon being fed from a spool and passing a roller) or ribbon elasticity (e.g. where printing ribbon is stretched under tension).

In general, the processing described above with reference to FIG. 6 is performed in parallel with the processing described above with reference to FIG. 4. Furthermore, the processing described with reference to FIG. 6 is not intended to cause ribbon movement, instead the processing performs monitoring, and generates as outputs correction amounts of steps, and diameter values which are fed into the main ribbon control processing described above with reference to FIG. 4. Moreover, the processing of described with reference to FIG. 6 is generally carried out while the ribbon is in motion. That is, there is no need for the ribbon to be stationary for a diameter update to be made, or for correction steps to be applied to the motors. Such on-the-fly updates and corrections allow tension in the ribbon to be maintained during an extended movement sequence which may involve a large number of printing operations spread across a series of printing bursts.

The printer controller 9 has been described above, as has a stepper motor controller and various circuitry associated therewith. It will be appreciated that the printer controller 9 can take any suitable form (e.g. it may be a programmable microprocessor in communication with a memory storing appropriate instructions, or it may comprise bespoke hardware elements such as an ASIC). The stepper motor controller may be integral with the printer controller 9, although in some embodiments the stepper motor controller is a controller dedicated to control of one or more stepper motors which communicates with the printer controller 9. It will be appreciated that the printer controller 9 may be provided by a plurality of discrete devices. As such, where functions have been attributed to the printer controller 9, it will be appreciated that such functions can be provided by different devices which together provide the printer controller 9.

It will be appreciated that while it is described above that images in a burst are formed upon regions of a single substrate, images in a burst may be formed upon a plurality of substrates. For example, consecutive images may be formed upon adjacent substrates.

While various embodiments of the invention have been described above, it will be appreciated that various modifications can be made to the described embodiments without departing from the spirit and scope of the present invention. Where examples are provided for printing operation speeds, image dimensions or numbers, it will be appreciated that these exemplary values are not intended to be in any way limiting.

The invention claimed is:

1. A method of operating a transfer printer, the transfer printer comprising: first and second spool supports each being configured to support a spool of ribbon; a ribbon drive configured to cause movement of ribbon from the first spool support to the second spool support along a predetermined ribbon path; and a printhead, the printhead being configured to selectively transfer ink from the ribbon to a substrate as the substrate is moved relative to the printhead in a direction of substrate movement, the method comprising:

i) driving the ribbon in a direction parallel to the direction of substrate movement;

ii) printing a first plurality of images onto a first respective plurality of substrates;

iii) driving the ribbon in a direction opposite to the direction of substrate movement;

iv) driving the ribbon in the direction parallel to the direction of substrate movement; and v) printing a second plurality of images onto a second respective plurality of substrates;

wherein:

printing each image of the first and second pluralities of images results in corresponding pluralities of first and second negative images being formed on the ribbon;

each negative image of the first plurality of negative images is located adjacent a negative image of the second plurality of negative images on the ribbon; and each of the first plurality of images is offset from each of the other ones of the first plurality of images by a predetermined offset in the direction of substrate movement.

2. A method according to claim 1 wherein each of the first plurality of images is spaced apart from each of the other ones of the first plurality of images by a predetermined distance in the direction of substrate movement.

3. A method according to claim 1 wherein the ribbon is advanced between printing each of the first plurality of images by an amount which is based upon an integer multiple of a length of each of the images in the direction of substrate movement.

4. A method according to claim 3 wherein the amount which is based upon an integer multiple of a length of each of the images comprises an amount which is substantially equal to an integer multiple of a length of each of the images and an amount which is substantially equal to an integer multiple of a length of a separation between each of the images.

5. A method according to claim 1 wherein the first plurality of substrates comprise regions of a single substrate.

6. A method according to claim 5 wherein the second plurality of substrates comprise regions of said substrate.

7. A method according to claim 6 wherein each of the second plurality of images is spaced apart on said substrate by a predetermined distance in the direction of substrate movement.

8. A method according to claim 1 wherein driving the ribbon in a direction opposite to the direction of substrate movement comprises driving the ribbon by an amount which is based upon an integer multiple of a length of each of the images and the number of images in the first plurality of images.

9. A method according to claim 1 wherein the ribbon is driven during the printing of each of the first plurality of images at a printing speed which is based upon the speed of movement of the substrate relative to the printhead.

10. A method according to claim 9 wherein the ribbon is driven for at least some time between the printing of each of the first plurality of images at a ribbon transfer speed which is different to the printing speed.

11. A method according to claim 10 wherein the ribbon transfer speed is selected such that the ribbon is advanced between printing each of the first plurality of images by an amount which is based upon an integer multiple of a length of each of the images.

12. A method according to claim 1 wherein the ribbon is driven for at least some time between the printing of each of the first plurality of images at a tension monitoring speed.

13. A method according to claim 1 wherein tension in the ribbon extending between the spools is controlled so as to be substantially equal to a predetermined tension value.

14. A method according to claim 1 wherein tension in the ribbon extending between the spools is monitored at a time between the printing of at least two of the first plurality of images.

15. A method according to claim 14 wherein a length of ribbon to be added to or subtracted from the length of ribbon extending between the spools to control the tension so as to be substantially equal to a predetermined tension value is determined based upon the monitored tension.

16. A method according to claim 15 wherein the determined length of ribbon is added to or subtracted from the length of ribbon extending between the spools at a time between the printing of at least two of the first plurality of images.

17. A method according to claim 1 further comprising determining the diameter of at least one of the spools of ribbon during the printing of the first plurality of images, wherein the at least one spool is controlled based upon the determined diameter at a time between the printing of at least two of the first plurality of images.

18. A transfer printer comprising:

first and second spool supports each being configured to support a spool of ribbon;

a ribbon drive configured to cause movement of ribbon from the first spool support to the second spool support along a predetermined ribbon path;

a printhead, the printhead being configured to selectively transfer ink from the ribbon to a substrate as the substrate is moved relative to the printhead in a direction of substrate movement, and a controller arranged to cause the ribbon drive to carry out a method according to claim 1.

19. A computer program comprising computer readable instructions arranged to carry out a method according to claim 1.

20. A computer readable medium carrying a computer program according to claim 19.

* * * * *